United States Patent [19]

Knauer et al.

[11] 4,350,337

[45] Sep. 21, 1982

[54] ENERGY SAVING ARRANGEMENT FOR BOWLING APPARATUS

[75] Inventors: Joseph Knauer, Brooklyn; Howard Moskowitz, Howard Beach, both of N.Y.

[73] Assignee: Kilo-Wattch-Dog, Inc., Melville, N.Y.

[21] Appl. No.: 107,412

[22] Filed: Dec. 26, 1979

[51] Int. Cl.[3] ..... A63D 5/00

[52] U.S. Cl. ..... 273/43 A; 273/54 R; 318/487; 318/729

[58] Field of Search ..... 273/43 R, 43 A, 54 R, 273/49; 318/400, 403, 484, 487, 729

[56] References Cited

U.S. PATENT DOCUMENTS

| | | | |
|---|---|---|---|
| 1,754,779 | 4/1930 | Thurston | 318/729 |
| 3,166,318 | 1/1965 | Barger | 273/54 R |
| 3,172,663 | 3/1965 | Goldstein | 273/54 R |
| 3,189,348 | 6/1965 | Keahey | 273/54 R UX |
| 3,889,947 | 6/1975 | Short | 273/43 A |
| 4,151,993 | 5/1979 | Payne et al. | 273/43 A |
| 4,275,884 | 6/1981 | Smith | 273/43 A |

*Primary Examiner*—Anton O. Oechsle
*Attorney, Agent, or Firm*—Jacobs & Jacobs

[57] ABSTRACT

An energy saving arrangement in which motors performing mechanical work in automatic pin spotters are disconnected from power lines when a bowling play is discontinued after a predetermined time interval. A time delay relay is repeatedly actuated by a circuit connected to the rake latching bar. The time delay relay maintains a control relay energized provided that the rake latching bar actuates the circuit to the time delay relay within a predetermined time interval. If no such actuation takes place, then the control relay is released and the power motor for the pin spotter is switched off. The motor controlling the speed of the ball toward the bowler is similarly switched off after a predetermined time delay from the instant that the ball actuates a switch on its way back to the bowler or after a predetermined time delay after the rake latching bar is released. A capacitor bank is provided, furthermore, to correct the power factor of the energy applied to the motor and thereby results in energy savings.

6 Claims, 3 Drawing Figures

ENERGY SAVING ARRANGEMENT FOR BOWLING APPARATUS

BACKGROUND OF THE INVENTION

In the use of bowling equipment having automatic pin spotters and other mechanical devices operated by motors, it is desirable to switch the motors off when they are not being used. Such motor control arrangement provides both for savings of energy, and prolonging motor life.

Interrupting the motor operations when a bowler leaves the area or takes an extended recess, for example, can result in significant savings in operating cost as a result of savings of motor power. At the same time, however, additional efficient operation results therefrom in prolonging the operating life of the motor. When the motors operate continuously, for example, they will experience elevated temperatures, and these higher temperatures contribute to the deterioration of the insulation of the motor windings, and thereby reduce the operating lives of the motors.

The inductive power used by the motors, also result in an unfavorable power factor.

SUMMARY OF THE INVENTION

Accordingly, it is an object of the present invention to provide an arrangement which disconnects the operating motors from their respective power lines when the motors are not being used because of a discontinuance of bowling by players.

Another object of the present invention is to provide an arrangement, of the foregoing character, which also serves to correct the power factor with respect to the inductive power used by the motors.

A further object of the present invention is to provide an arrangement, as described, which is substantially simple in construction and may be economically fabricated, as well as easily installed.

The objects of the present invention are achieved by providing that a time delay relay is actuated every time the rake latching bar actuates a switch at the end of its upward movement, for example. Actuation of the switch energizes the time delay relay which, in turn, remains energized for a predetermined time interval. During that time interval, a control relay is also held in energized state. If the switch actuated by the rake remains unactuated during the delay interval of the time delay relay, then this time delay relay becomes released and the control relay is similarly released. Release of the control relay causes the power to the respective motors to be discontinued.

In accordance with the present invention, furthermore, a manual-actuated toggle switch can connect the motors directly to their respective power lines and bypass the time delay circuit, so that the motors are operated continuously. This mode of operation permits localization of a malfunction in the time delay circuit, for example. A similar time delay circuit is provided for the motor which controls the speed of the ball towards the bowler.

Suitable indicators are provided to enable operating personnel to determine whether the time delay circuits are in use or not.

A bank of capacitors are connected across the power lines to the motors when the time delay circuit is in use, for the purpose of correcting the power factor.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
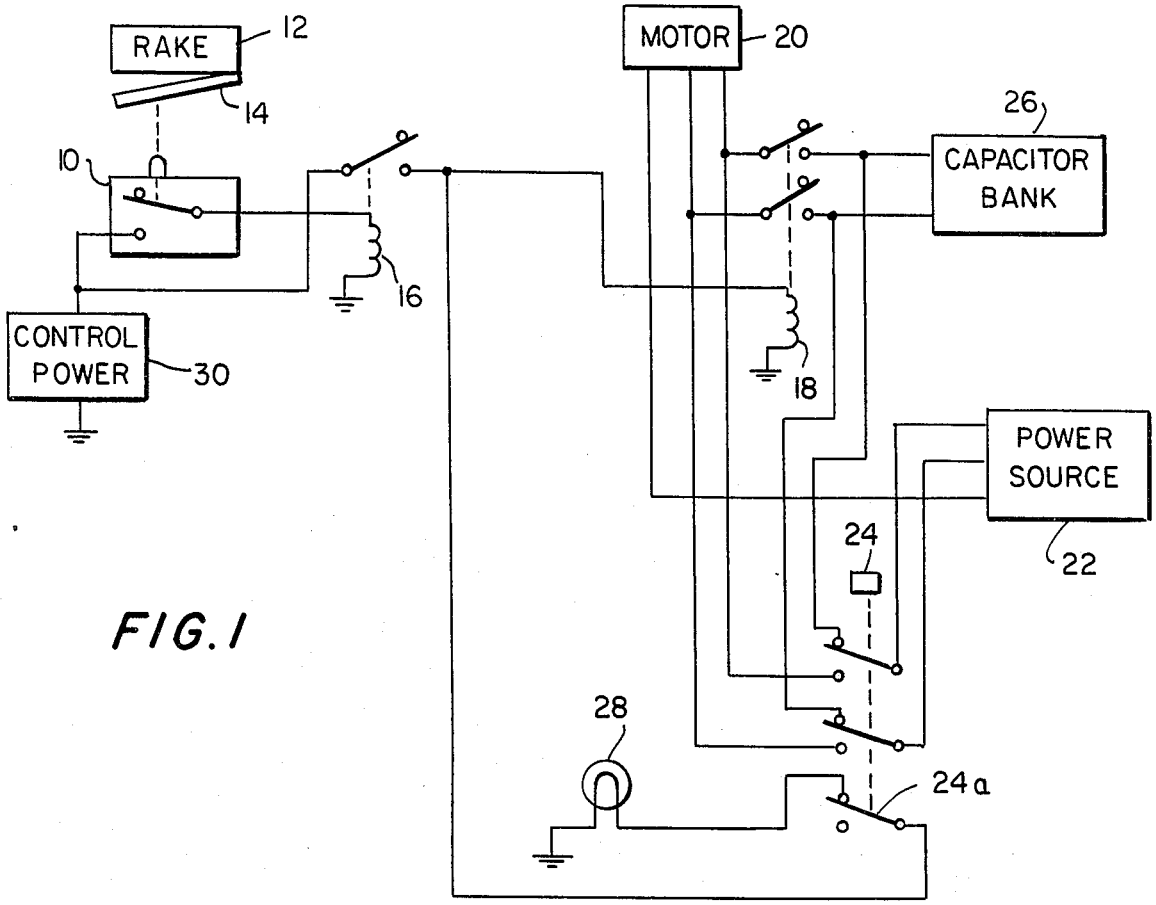
FIG. 1 is an electrical circuit diagram and shows the motor control arrangement for disconnecting the motor for the pin setter.

Referring now to FIG. 1 of the drawings, there is shown a microswitch 10 which becomes actuated whenever the rake is at the end of its upward movement. Accordingly, movement of the rake 12 actuates the bar 14 which is mechanically connected to the switch 10 often referred to as a microswitch. Actuation of the switch 10 closes a circuit to the time delay relay 16 which then remains energized for a period of time of its associated time delay, usually up to 30 seconds in practice. Upon actuation of the time delay relay 16, the control relay 18 is also energized. In the energized state of the control relay 18, the pin setting motor 20 has applied to it power from the source 22. As may be seen from FIG. 1, the connecting lines from the power source 22 pass through a manually actuated toggle switch 24. Thus, two lines of the single-phase power pass through two poles of the toggle switch 24. In the circuit shown in FIG. 1, the toggle switch is in the position in which power from the source 22 passes through the toggle switch 24, as well as the control relay 18, before being applied to the motor.

When it is desired to operate the motor 20 in a continuous manner directly from the power source 22, the toggle switch 24 is manually switched to the opposite position in which the lines from the power source are directly connected to the motor. In this mode of operation, the power flow does not take place through poles of the control relay 18.

The control relay 18 will become released, and thereby interrupt the flow of power to the motor 20, when the time delay relay 16 becomes released. At the same time, the time delay relay 16 will become released when the switch 10 does not become repeatedly actuated within the respective time interval associated with the time delay relay. Consequently, when the bowler interrupts the play, for any reason, so that it is no longer necessary to operate the motor 20 during such an interruption of the game, then the rake will not repeatedly move and the latching bar 14 will not repeatedly actuate the switch 10. The time delay relay 16 becomes thereby released, and this results in the release of the relay 18, so that the motor 20 discontinues its operation.

A bank of capacitors 26 are connected to the poles of the control relay 18, so that they correct the power factor while the motor is in operation with the time delay circuit connected when the toggle switch 24 is in the position shown in the drawing. When the toggle switch 24 is in the opposite position, the capacitor bank 26 is disconnected from being across the motor 20. Thus, when the motor 20 is fed directly from the power source without being controlled by the relay 18, the capacitor bank 26 is not connected across the power lines to the motor.

The toggle switch 24 is provided with an auxiliary pole 24*a* for the purpose of energizing an indicating lamp 28 whenever the control relay 18 is energized.

The time delay relay 16, control relay 18 and indicating lamp 28 are operated from a source of control power 30 which is at a substantially lower voltage, for example, 24 volts, than the voltage of the power source 22 applied to the motor 20.

Figure 2:
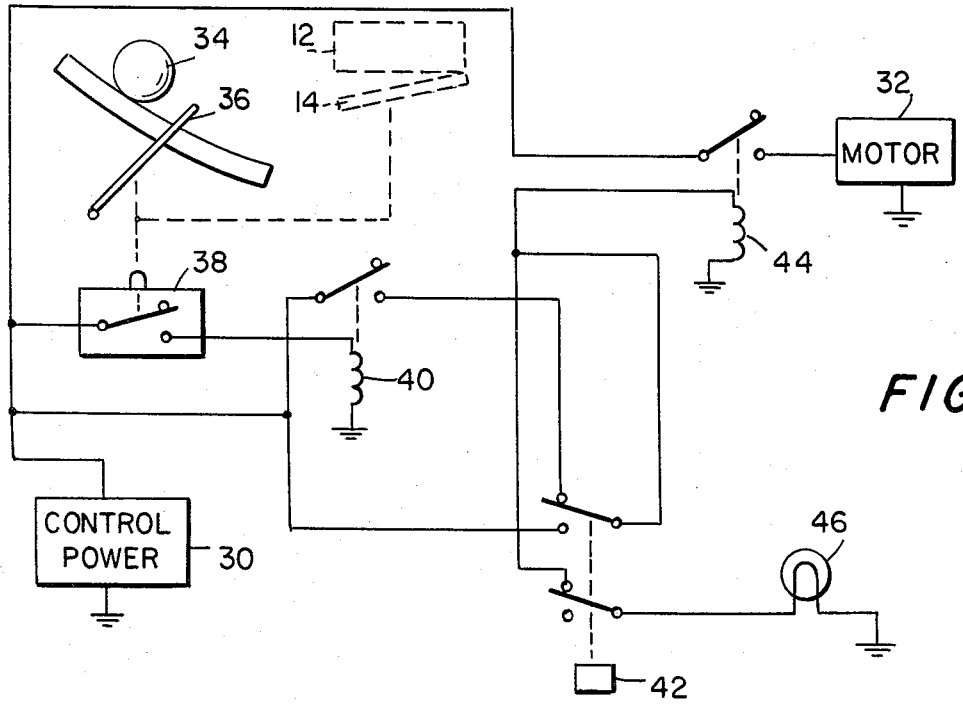
FIG. 2 is an electrical circuit diagram and shows the arrangement for controlling the motor associated with the ball return.

FIG. 2 shows the arrangement used to disconnect the motor 32 from the source 30 when the ball return is not repeated. Thus, the ball 34 during its way back to the bowler, strikes an actuator bar 36 which, in turn, actuates the switch 38, also similar to a commonly-referred microswitch. Alternatively, as shown in phantom lines in FIG. 2, the switch 38 can be actuated by release of the rake latching bar 14, and this may be preferred in some instances. Upon actuation of this switch 38, a further time delay relay 40 becomes energized and remains in this energized state for the time interval associated with the delay relay, usually up to 30 seconds in practice. Depending upon the position of a further toggle switch 42, the control relay 44 is energized through a pole of the time delay relay 40, or directly from the source 30, which is also the source for the motor 32.

When the toggle switch 42 is in the position shown in the drawing in FIG. 2, the relay 44 remains actuated or energized only for the time during which the time delay relay 40 is also energized. When the time delay relay 40 becomes released because the switch 38 is not repeatedly actuated within the required time interval associated with the relay 40, the relay 44 becomes released and the power to the motor 32 is discontinued.

When, on the otherhand, the toggle switch 42 is in the opposite position to that shown in FIG. 2, then the relay 44 remains continuously energized by being connected directly to the source 30, and as a result the motor 32 is continuously operated. The toggle switch 42 includes a pole connected to an indicating lamp 46 which is lighted whenever the relay 44 is energized during the mode of operation in which a relay 44 is controlled by the time delay relay 40.

Figure 3:
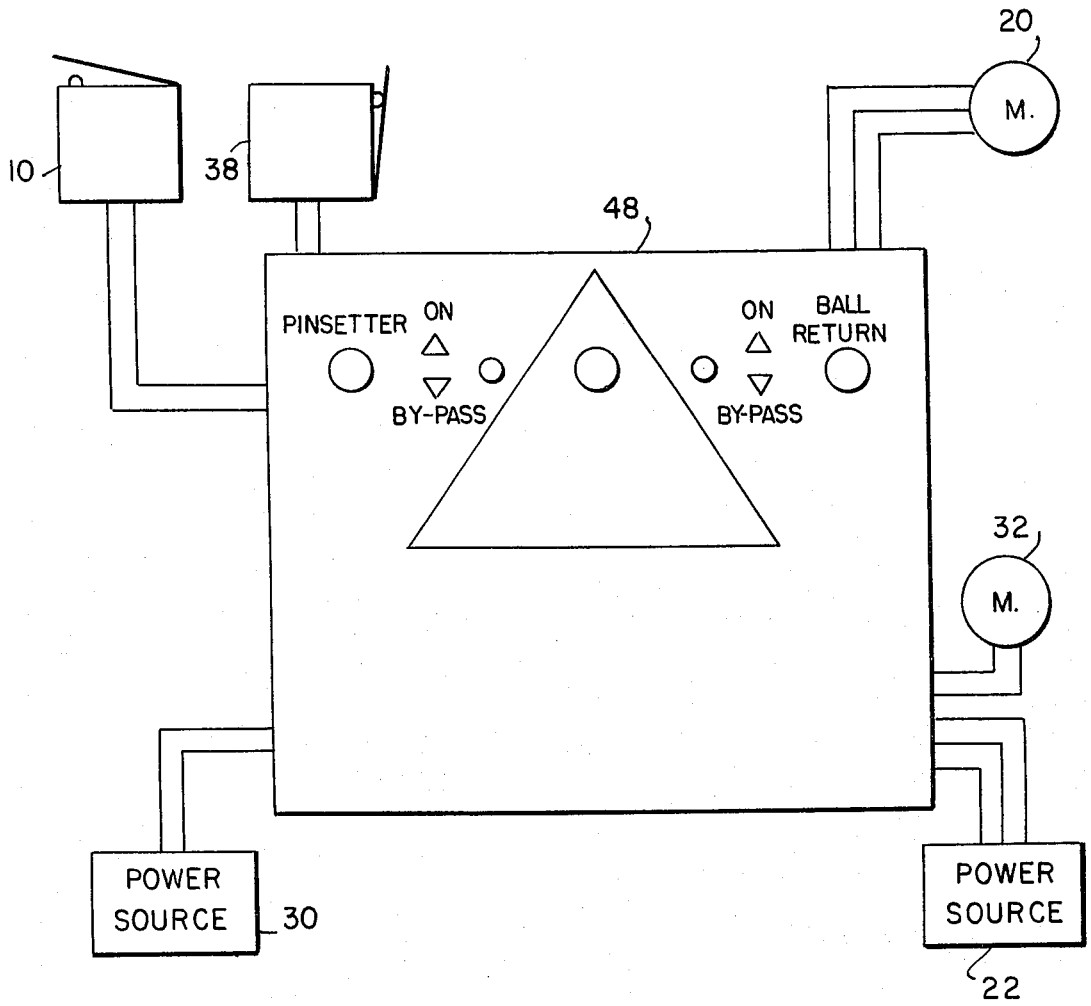
FIG. 3 is a schematic diagram and shows the arrangement for installing the energy saving unit in an established bowling equipment.

FIG. 3 shows the manner in which the energy saving apparatus can be easily installed in existing bowling equipment. Thus, the circuits of FIG. 1 and FIG. 2 can be all enclosed within the housing 48, and the latter becomes connected to the motors 20, 32 and power sources 22, 30. The connection between the housing 48 and the switches 10 and 38 are also shown. The arrangement of FIG. 3 illustrates how the unit can be readily and quickly installed in the usual bowling equipment, without requiring a complex interconnecting and interface circuit arrangement.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. An energy saving arrangement for bowling equipment, comprising: switching means actuated by pin setting means during motion thereof; time delay means connected to said switching means and held in an operative state after actuation of said switching means; control circuit means operated by said time delay means and connecting a motor for pin setting to a source of power only during the operative state of said time delay means; said time delay means being set to an inoperative state when said switching means after being actuated is not re-actuated within a predetermined time interval; said motor being continuously connected to said source of power when a bowler plays continuously at a predetermined pace so that said switching means is continuously re-actuated, said time interval being dependent on said pace, said motor being disconnected from said source of power when the bowler discontinues playing for a time length exceeding said time interval whereby said switching means is not re-actuated within said predetermined time interval; manually-operated switching means for connecting, in one state of operation, said motor directly to said source of power, and connecting in a second state of operation said source of power to said control circuit means; capacitor means connected to said control circuit means so that said capacitor means is connected across said motor in the second-mentioned state of said manually operated switching means; second switching means operatively connected to and actuated by ball return means when returning a ball to a bowler or said pin setting means; second time delay means connected to said second switching means and held in an operative state after actuation of said second switching means, second control circuit means operated by said second time delay means and connecting a second motor for the ball return to a source of power only during the operative state of said second time delay means; said second time delay means being set to an inoperative state when said second switching means after being actuated is not reactuated within a predetermined time interval; and second manually operated switching means having a first state for connecting said second control circuit means to said second time delay means, and having a second state for connecting said control circuit means directly to the source of power for said second motor means.

2. An arrangement as defined in claim 1 wherein said first and second time delay means comprises a time delay relay.

3. An arrangement as defined in claim 1 wherein said first and second control circuit means comprises electromagnetic relay means.

4. An arrangement as defined in claim 1 including first indicating means connected to said first control circuit means through said first manually operated switching means for indicating operation of said motor for pin setting; and second indicating means connected to said second control circuit means through said second manually operated switching means for indicating operation of said motor for ball return.

5. An arrangement as defined in claim 1 including housing means connectable directly to said sources of power, motors, and first and second switching means for energy saving operation.

6. An arrangement as defined in claim 11, wherein said first and second time delay means comprises a time delay relay; said first and second control circuit means comprising electromagnetic relays means; first indicating means connected to said first control circuit means through said first manually operated switching means for indicating operation of said motor for pin setting; and second indicating means connected to said second control circuit means through said second manually operated switching means for indicating operation of said motor for ball return; housing means connectable directly to said sources of power, motors, and first and second switching means for energy saving operation.

* * * * *